United States Patent [19]

Fischer, Jr.

[11] 3,975,880

[45] Aug. 24, 1976

[54] SHEET METAL BATTEN ROOF OR SIDING

[75] Inventor: Harry F. Fischer, Jr., Pittsburgh, Pa.

[73] Assignee: All-State Industries, Inc., McKees Rocks, Pa.

[22] Filed: Apr. 28, 1975

[21] Appl. No.: 571,915

[52] U.S. Cl. ..... 52/464; 52/469; 52/573

[51] Int. Cl.[2] ..... E04D 1/36; E04C 1/34

[58] Field of Search ..... 52/459, 460, 461, 463, 52/465, 466, 467, 468, 469, 470, 573

[56] References Cited

UNITED STATES PATENTS

| | | | |
|---|---|---|---|
| 2,045,055 | 6/1936 | Schadler | 52/467 |
| 2,060,093 | 11/1936 | Markel | 52/461 |
| 2,626,156 | 1/1953 | Bergh | 85/50 R |
| 2,976,648 | 3/1961 | Linck | 52/467 |
| 3,327,443 | 6/1967 | Gay | 52/467 |
| 3,335,537 | 8/1967 | Mackey | 52/467 |
| 3,376,680 | 4/1968 | Gyekis | 52/467 |

FOREIGN PATENTS OR APPLICATIONS

| | | | |
|---|---|---|---|
| 1,198,536 | 6/1959 | France | 52/465 |

*Primary Examiner*—Ernest R. Purser
*Assistant Examiner*—William Randolph
*Attorney, Agent, or Firm*—Brown, Murray, Flick & Peckham

[57] ABSTRACT

Rows of longitudinally spaced channel-like brackets are secured to supporting means for a sheet metal roof or siding and each bracket has spaced side walls with flanges extending downwardly from their tops. A gutter extends through the brackets in each row and is supported by them. A clip overlies the gutter in each bracket and is hooked under the bracket flanges. Sheet metal pans on the roof-supporting means at opposite sides of the gutter have side portions extending upwardly beside the brackets, with their upper marginal areas turned inwardly over the clips and gutter. A cap above the gutter and overlying clips has downwardly extending side flanges overlapping the side portions of the pans. Screws extend down through the cap and into the central portions of the clips, which engage the lower surface of the cap, to fasten the cap to the clips. The cap and at least all but one of the clips are free to slide lengthwise together relative to the pans and brackets during thermal expansion and contraction of the sheet metal roof.

6 Claims, 7 Drawing Figures

SHEET METAL BATTEN ROOF OR SIDING

One of the problems with sheet metal roofs and the like, such as sheet metal siding for side walls, arises as a result of thermal expansion and contraction of the metal. If the different metal elements of a roof, for example, are fastened securely to one another or to the roof supports, buckling of some of the elements is likely to occur during expansion, or some of them may be pulled loose from others during either expansion or contraction. For example, in U.S. Pat. No. 3,327,443 a gutter extends through a row of brackets that are rigidly fastened to a supporting structure, and a batten cap covering the gutter and the adjoining edges of the metal pans is connected by screws to clips in the gutters. When these screws are tightened, the pans and brackets and gutter are clamped tightly together between the cap and clips as shown in FIG. 11 of that patent. No provision is made for relative movements between the different elements as they expand and contract.

It is among the objects of this invention to provide a sheet metal roof or the like of the general type shown in the above-mentioned patent, in which the different elements are allowed to expand and contract relative to one another without restraint, and yet in which they are connected securely together in such a way that the roof will not leak or become loose.

The invention is illustrated in the accompanying drawings, in which

Figure 1:
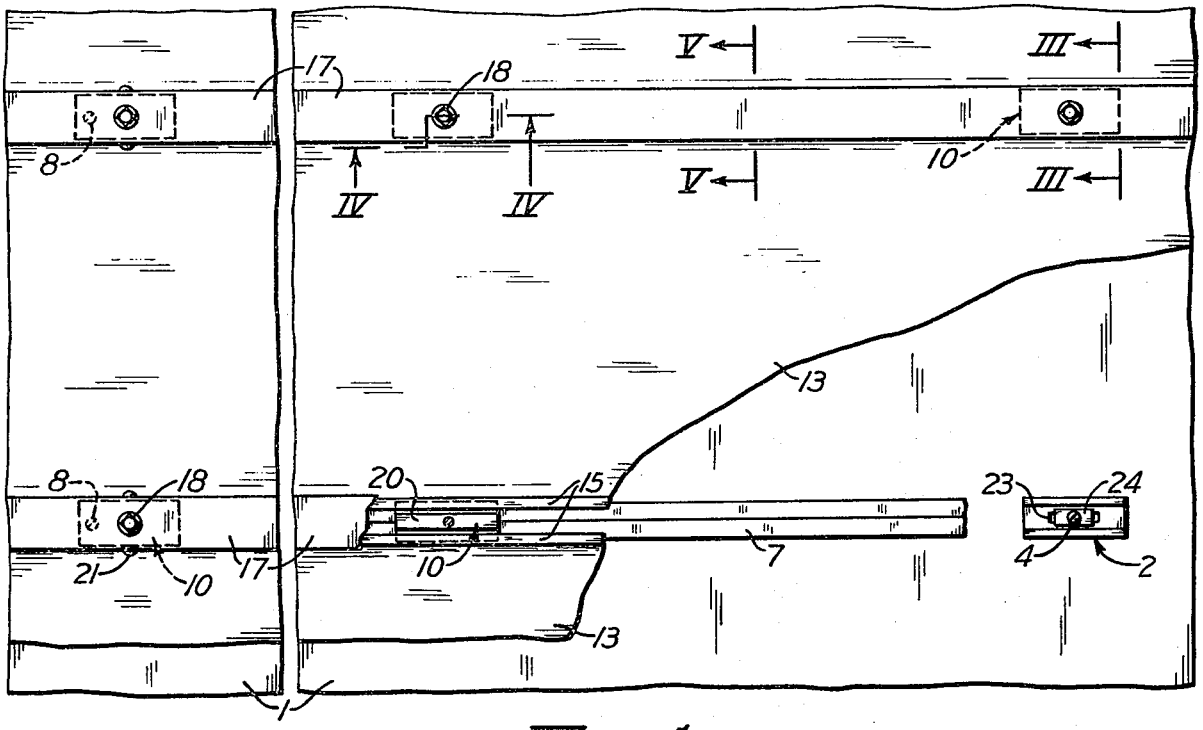
FIG. 1 is a fragmentary plan view of a roof.
Figure 2:
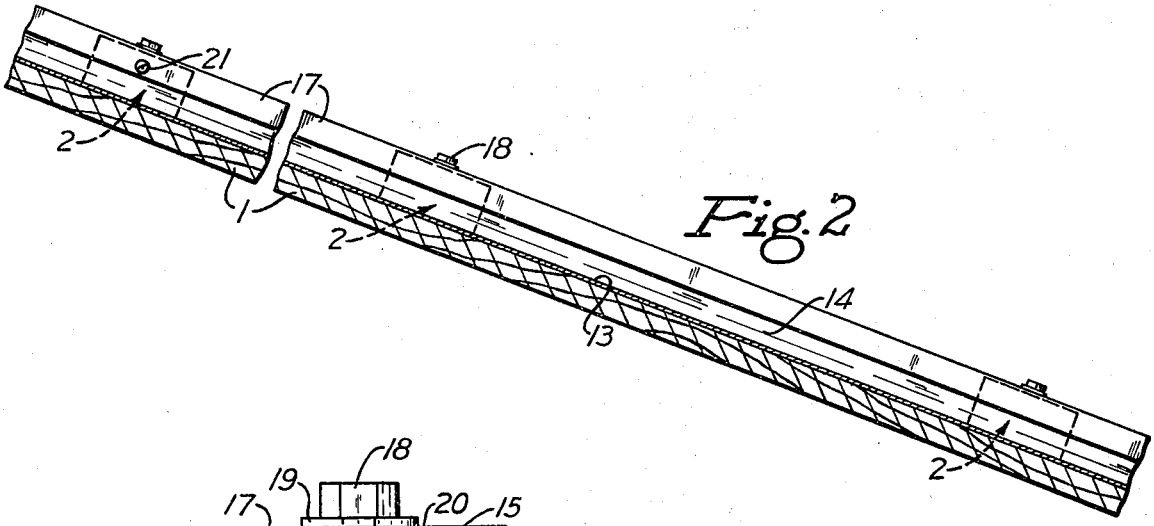
FIG. 2 is a longitudinal vertical section.

Referring to FIGS. 1 to 5 of the drawings, a sheet metal roof is laid over any suitable supporting base, such as wooden sheathing 1 supported by rafters. The roof slopes lengthwise of the rafters. Supported above each rafter or above selected rafters is a row of channel-like brackets 2 that are spaced apart a predetermined distance. Each bracket has spaced side walls 3, the lower portions of which are more or less parallel and the upper portions of which flare or diverge upwardly. A screw 4 extends through the flat bottom wall of the bracket and down into the sheathing and underlying rafter. Each bracket also has flanges 5 extending substantially straight down from the tops of its side walls, so they are spaced outwardly from those walls.

A gutter 7 extends through the brackets in each row, with the inclined upper portions of its side walls resting flat against the flaring sides of the brackets. The gutter may taper down in cross section to a point a short distance above the fastening screws 4, or the lower portions of the gutter can be substantially parallel and extend down beside the parallel side walls of the brackets. Although the arrangement can be such that the gutter is free to slide lengthwise in all of the brackets during thermal expansion and contraction of the gutter, it is preferred that it be secured to one of the brackets to prevent it from creeping along the brackets. For best results, the gutter is fastened by one or more screws to a bracket about midway of the row of brackets. This bracket may be rigidly connected to the underlying sheathing 1 by means of a screw 8 (FIG. 1) and near one end of the bracket.

Overlying the gutter and each bracket supporting it there is a clip 10 that is hooked under the bracket flanges. That is, the clip extends across the bracket and then has side flanges 11 extending down beside the bracket flanges 5 and hooked under their lower edges. Each clip is applied to a bracket by setting it on the gutter and then sliding the clip endwise onto the bracket from one end. There is enough clearance between the clip and the bracket to prevent them from binding together and to prevent the clip from pressing the gutter tightly against the bracket.

Figure 5:
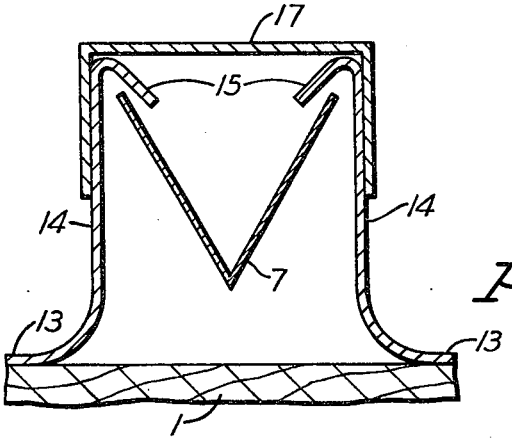
FIG. 5 is an enlarged cross section taken on the line V—V of FIG. 1.

At each side of the bracket there is a sheet metal pan that has a flat body 13 and substantially vertical upwardly extending side portions 14, the upper marginal areas 15 of which are turned inwardly over the adjoining clips and gutters. Each inturned area slopes down over correspondingly sloped areas of the clips beside it and also slopes down into the gutter where it extends between the clips as shown in FIG. 5. The upwardly extending side portions of the pan are integrally connected to the flat pan body between them by a curved portion.

The gutter and the clips above it are covered by a cap 17 that extends lengthwise of the gutter and has downwardly extending side flanges overlapping the vertical side portions 14 of the pans. This cap is rigidly connected to each clip 10 by a screw 18 and a sealing washer 19, the screw extending down through the central portion of the clip. To prevent the screw from clamping the inturned marginal areas 15 of the pans between the cap and clips, a thickened central portion 20 of each clip extends above the rest of the clip far enough to provide the desired clearance for the pans. It will, therefore, be seen that the cap and clips are free to slide lengthwise together relative to the pans and brackets, and the side portions of the pans are free to slide lengthwise between the clips and cap except that the cap and pans preferably are fastened rigidly by screws 21 (FIG. 1) to the same bracket to which the gutter is secured so that the cap and pans will expand in opposite directions from that bracket. Aside from these screws, there is nothing to restrain thermal expansion and contraction of the different metal elements of the roof. However, under certain circumstances, particularly in the case of steep roofs or batten siding, the brackets that are held stationary by screws 8 and to which the gutters, pans and caps are fastened rigidly by screws may more advantageously be fastened to the upper end of the supporting means so that expansion and contraction will occur from the top. This makes it unnecessary for the pans and other members to expand up the slope or wall against gravity, which might cause buckling.

Figure 4:
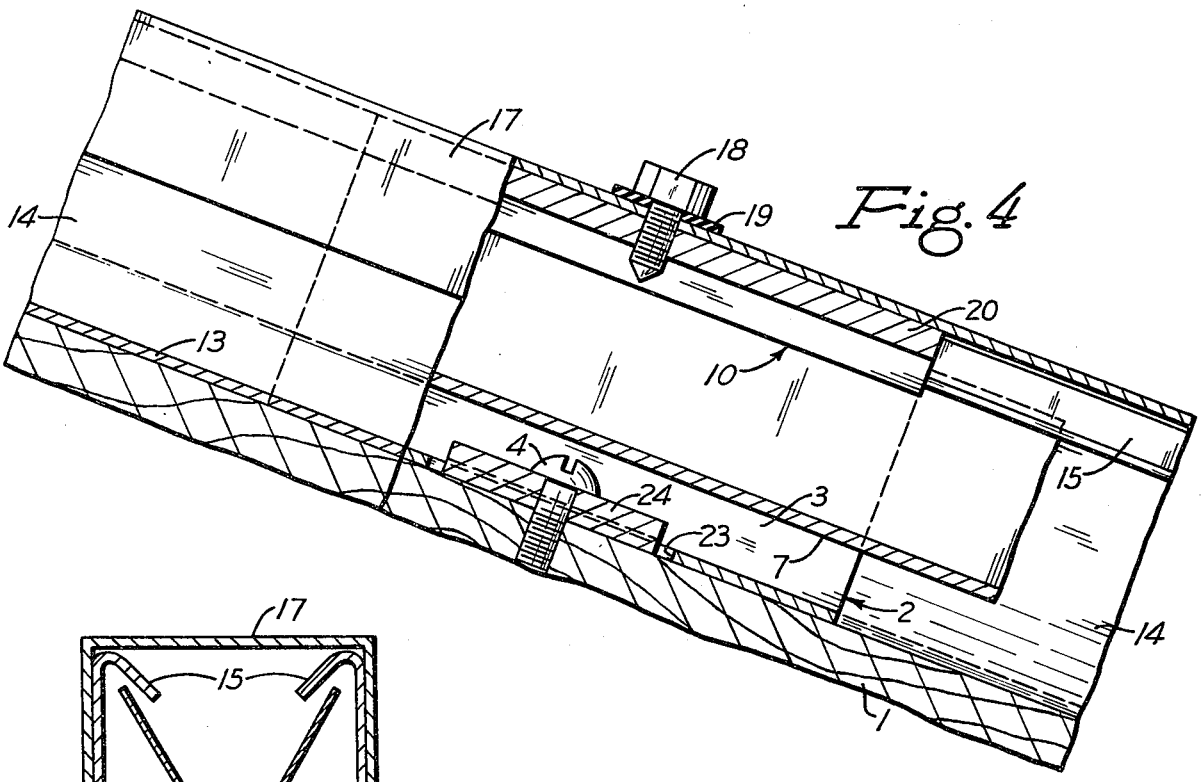
FIG. 4 is an enlarged longitudinal vertical section taken on the line IV—IV of FIG. 1.

To give even more flexibility to the system, the opening in the bottom of each bracket for screw 4 may be a rectangular slot 23 extending lengthwise of the bracket, as shown in FIGS. 1 and 4. To provide a substantial area of contact so that there will be no chance of the bracket pulling away from the screw, a long washer 24 having a bottom rib extending down into the bracket slot is used. The rib is slightly thicker than the bottom wall of the bracket and is shorter than the slot so that, if necessary, the bracket can slide lengthwise relative to screw 4 and the washer.

The brackets and clips are made most economically by extruding long bars of aluminum, or brass if the pans are to be copper, into the desired cross sectional shapes and then cutting the bars every few inches to produce the brackets and clips. Of course, the brackets could be made by bending sheet metal into the desired shape, but that is a costlier method. Aluminum can be used with stainless steel, terne or galvanized iron pans and caps, because the different elements can move independently of one another due to different coefficients of thermal expansion and contraction.

Figure 6:
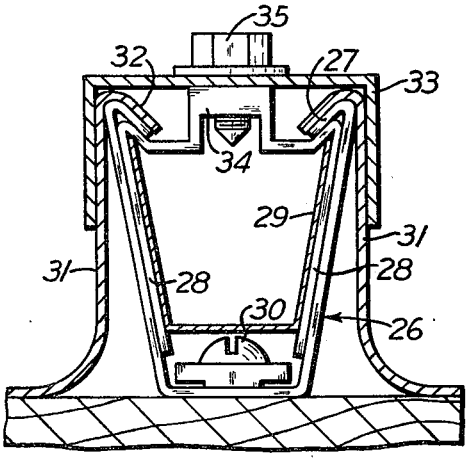
FIG. 6 is a cross section, similar to FIG. 3, of a modification.

In the modification shown in FIG. 6 each bracket 26 has straight side walls inclined outwardly from bottom to top, and the integral flanges 27 at the upper ends of the side walls slope inwardly toward each other instead of extending straight down outside of the bracket. These flanges overlie side areas of a clip, but do not tightly engage it. The side flanges 28 of the clip extend downwardly along the inner surfaces of the side walls of the bracket between those walls and the opposite inclined sides of a gutter 29, which has a flat bottom above the bracket-holding screw 30. The upwardly extending side portions 31 of the metal pans have inturned downwardly converging upper marginal areas 32 that are wide enough to overlap the upper edges of the gutter between the brackets. The gutter and the clips are covered by a flanged cap 33 secured to the upwardly extending central portion 34 of the clips by screws 35. The bracket flanges 27 and the converging marginal areas of the pans are not clamped between the clip and the cap, so longitudinal expansion and contraction of the different elements are not restricted.

Figure 3:
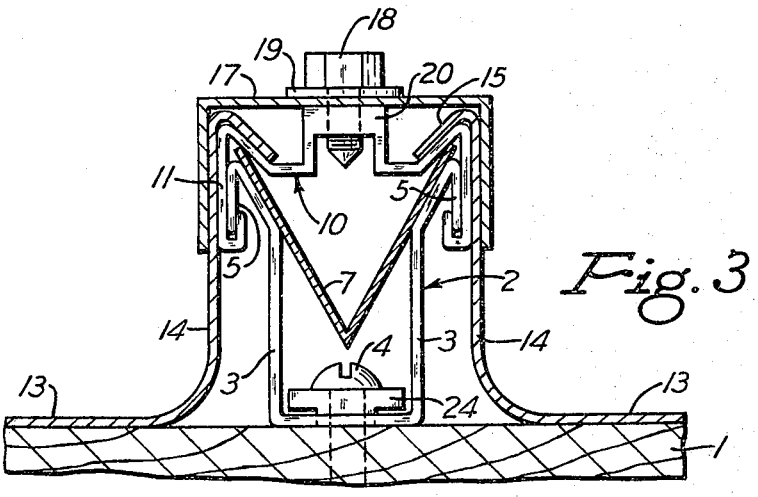
FIG. 3 is an enlarged cross section taken on the line III—III of FIG. 1.
Figure 7:
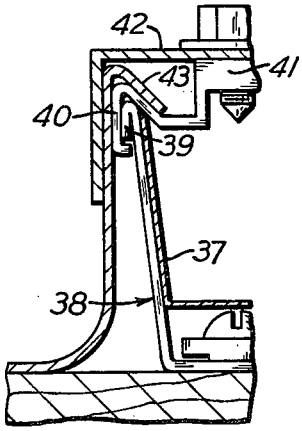
FIG. 7 is a fragmentary cross section, also similar to FIG. 3, of a further embodiment of the invention.

In the further embodiment shown in FIG. 7 the gutter 37 and the bracket 38 are the same general shapes as those shown in FIG. 6, except that the flanges 39 along the top of the bracket extend downwardly outside of the bracket, and the side flanges 40 of the overlying clip extend down beside the bracket flanges and beneath them in a manner similar to that shown in FIG. 3. The upwardly extending central portion 41 of the clip prevents the clip and cap 42 from clamping the inclined marginal areas 43 of the metal pans between them, so expansion and contraction are not restrained.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. In a sheet metal roof or siding, supporting means, a row of longitudinally spaced channel-like brackets secured to said supporting means, each bracket having spaced side walls with flanges extending downwardly from the tops of said walls, a gutter extending through said brackets and supported thereby, a clip overlying the gutter in each bracket and hooked under said bracket flanges and engageable therewith, sheet metal pans on said supporting means at opposite sides of the gutter and having side portions extending upwardly beside said brackets, the upper marginal areas of said side portions being turned inwardly over said clips and gutter, a cap above the gutter and clips and extending lengthwise of the gutter and having downwardly extending side flanges overlapping said side portions of the pans, the central portions of said clips engaging the lower surface of the cap, the central portion of each clip extending above the rest of the clip to provide clearance between said cap and clip for said upper marginal areas of said pan side portions, and screws extending down through the cap and into said central portions of the clips to fasten the cap to the clips, the cap and at least most of the clips being freely slidable lengthwise together relative to the pans and brackets during thermal expansion and contraction.

2. In a sheet metal roof or siding according to claim 1, said bracket flanges being spaced outwardly from said bracket side walls, and said clips overlying the bracket flanges.

3. In a sheet metal roof or siding according to claim 1, said bracket flanges being spaced inwardly from said bracket side walls and disposed above said clips, and said clips having side flanges extending downwardly between said brackets and gutter.

4. In a sheet metal roof or siding according to claim 1, each of said brackets having a bottom wall provided with a rectangular slot extending lengthwise of the bracket, a washer provided with a bottom projection extending down into said slot and being thicker than said bottom wall, and a screw extending down through the washer and into said supporting means to fasten the bracket to said means, said washer projection being materially shorter than said slot to permit the bracket to move lengthwise relative to the washer.

5. In a sheet metal roof or siding according to claim 4, a bracket that is located substantially midway between the ends of said row of brackets having a hole through its bottom wall between one end of said slot and the adjacent end of the bracket, and a screw extending down through said hole and into said supporting means for anchoring the bracket.

6. In a sheet metal roof or siding according to claim 5, fastening means securing said cap and pans to said midway bracket.

* * * * *